United States Patent [19]

Watanabe et al.

[11] Patent Number: 4,949,065

[45] Date of Patent: Aug. 14, 1990

[54] RESISTOR COMPOSITION, RESISTOR PRODUCED THEREFROM, AND METHOD OF PRODUCING RESISTOR

[75] Inventors: Hirotoshi Watanabe, Osaka; Toru Ishida, Hirakata, both of Japan

[73] Assignee: Matsushita Electric Industrial Co., Ltd., Osaka, Japan

[21] Appl. No.: 247,064

[22] Filed: Sep. 20, 1988

[30] Foreign Application Priority Data

Sep. 21, 1987 [JP] Japan ..... 62-236521
Oct. 16, 1987 [JP] Japan ..... 62-262065

[51] Int. Cl.[5] ..... H01C 1/012

[52] U.S. Cl. ..... 338/308; 338/307; 361/400; 361/402

[58] Field of Search ..... 338/306, 307, 308, 309, 338/310, 314; 252/509, 519, 520, 521; 428/209; 361/400, 401, 402

[56] References Cited

U.S. PATENT DOCUMENTS

| | | | |
|---|---|---|---|
| 4,039,997 | 8/1977 | Huang et al. | 338/308 |
| 4,119,573 | 10/1978 | Ishida et al. | 252/519 |
| 4,225,468 | 9/1980 | Donohue et al. | 252/509 |
| 4,512,917 | 4/1985 | Donohue | 252/521 |
| 4,695,504 | 9/1987 | Watanabe et al. | 428/209 |

FOREIGN PATENT DOCUMENTS 62-232901 10/1987 Japan .

OTHER PUBLICATIONS

Donohue et al., Proceedings of 1987 Electronic Components Conference, Nitrogen-Fireable Resistors: Emerging Technology for Thick Film Resistors, May, 1987.

*Primary Examiner*—Bruce A. Reynolds
*Assistant Examiner*—Marvin M. Lateef
*Attorney, Agent, or Firm*—Wenderoth, Lind & Ponack

[57] ABSTRACT

A resistor composition containing no boride powder is obtained by mechanical grinding of at least one of silicon, silicon monoxide and higher oxidation state precursor of silicon monoxide; and a borosilicate glass containing at least one of zirconium oxide, vanadium pentoxide, chromium oxide, tungsten trioxide, molybdenum trioxide, manganese oxide, titanium oxide, niobium pentoxide and tantalum pentoxide, which are capable of being reduced with silicon, silicon monoxide or higher oxidation state precursor of silicon monoxide. In a sintering step in a non-oxidizing atmosphere, boron oxide and at least one another oxide contained in the borosilicate glass are reduced by silicon, silicon monoxide, higher oxidation state precursor of silicon monoxide or silicide, and metal elements of the oxides contained in the glass combine with each other, so that fine particles of boride are precipitated around glass particles to form a graze resistor.

31 Claims, 2 Drawing Sheets

BEFORE FIRING

AFTER FIRING

RESISTOR COMPOSITION, RESISTOR PRODUCED THEREFROM, AND METHOD OF PRODUCING RESISTOR

BACKGROUND OF THE INVENTION

1. Field of the Invention

The present invention relates to a thick film glaze resistor. More particularly the present invention relates to a resistor composition which can be fired in a non-oxidizing atmosphere such as a neutral atmosphere or a reducing atmosphere to form a resistor on a copper thick film hybrid integrated circuit (Cu-HIC) substrate or the like with the resistor coexisting with a base metal electrode, particularly a copper electrode, a resistor produced therefrom, and a method of producing a resistor.

2. Description of Prior Art

Demands for miniaturization and multi-functionalization of apparatuses have recently been growing year after year. To meet these demands, integration of circuits, and high-density packaging of circuit parts have become important techniques. Accordingly, passive elements such as capacitors and resistors have a tendency to be made in the form of thick film elements from the viewpoint of ease in packaging thereof on circuit substrates as well as miniaturization thereof.

Among conventional thick film elements, thick film resistors have heretofore been produced by using ruthenium oxide as a conductive phase and a lead borosilicate glass as an inorganic binder for fixing the resistor onto a ceramic substrate. The ruthenium oxide resistor is formed by a conventional thick film process, the basic procedure of which comprises screen printing, drying and firing.

The thick film process will be briefly described. Screen printing is effected by squeezing out a thick film composition in the form of a paste through an open pattern of a screen, which has been prepared by coating a stainless steel mesh with a resin resist and removing the resin resist only from part thereof to constitute the necessary open pattern, onto a substrate by means of a squeegee. By doing so, a necessary pattern of the composition corresponding to that of the stainless screen is formed on the substrate. After the printing, the film on the substrate is dried at 100° to 150° C. to remove the solvent contained in the film of the thick film paste through evaporation thereof. Thereafter, the film is fired generally in the air at a peak temperature of 600° to 1000° C. In this firing step, an organic polymer contained in the thick film composition for the purpose of providing printability therefor is decomposed by oxidation thereof with temperature elevation. Thereafter, the glass serving as an inorganic binder is softened and melted, and the melted glass solidifies again in the course from the peak temperature to ordinary temperatures, whereupon the composition, when it is a thick film resistor composition, adheres to the substrate with the conductive phase held in the glass matrix. Such thick film technique is discussed in detail by Planer, Philips in "Thick Film Circuit", LONDON BUTTERWORTH.

In the case where a ruthenium oxide resistor material is used, however, since the firing is effected in air, a noble metal material such as silver and palladium must be used as an electrode. Thus, conventional thick film systems using a ruthenium oxide resistor material is very expensive because a noble metal must be used therein as a conductor composition and a resistor composition. Further, various measures such as covering with a protective film must be taken to prevent wasting silver in soldering or from migrating.

Even if thought is given to formation in air of an $RuO_2$-glass type glaze resistor on a base metal electrode of, for example, tungsten, molybdenum or copper, the electrode material undergoes oxidation to make it impossible to form the glaze resistor on the electrode. In view of this, in order to form a glaze resistor on a base metal electrode, the glaze resistor composition must be fired in a reducing atmosphere or a neutral atmosphere. In this case, however, an $RnO_2$ glaze resistor material is defective in that the ruthenium oxide is reduced in the nature of the case to metallic ruthenium, when the glaze resistor material is fired in a non-oxidizing atmosphere, thereby failing to secure any characteristics of a resistor. In other words, the coexistence of a ruthenium oxide thick film resistor composition with a base metal electrode material such as copper was very difficult.

Thick film resistor compositions which can coexist with a base metal electrode material such as a copper electrode include a thick film resistor composition disclosed in U.S. Pat. No. 4,039,997 which comprises molybdenum silicide, tungsten silicide, etc. as a conductive phase, and a barium borosilicate glass as a glass phase. In the case of this thick film resistor composition, however, since the peak firing temperature is as high as 970° to 1,150° C., the life span of the furnace is unfavorably shortened in actual production. Further, since the peak temperature for thick film conductor materials for copper electrodes which are generally commercially available today is 900° C., the production of resistors from the above-mentioned thick film resistor composition by firing requires two types of furnaces with different peak temperatures or a furnace in which the peak temperature must be changed. Therefore, there arises such a problem that an excessive investment may be involved, or the production efficiency cannot be raised. Furthermore, since the particle diameter of the glass powder used in the thick film resistor composition is as small as 1 to 2 μm, the glass powder surfaces are melted before escape of an organic polymer contained in the thick film resistor composition through thermal decomposition thereof when the composition is fired in a non-oxidizing atmosphere, with the result that the organic polymer is retained in the form of carbon in the resulting resistor. This results in disadvantages such as destabilization of the thermal coefficient of the resistor and instability of the humidity resistance characteristics of the resistor. Further, where the particle diameter of the silicide in the thick film resistor composition exceeds 1 μm, the radius of the silicide particles is too large for the glass, with the result that wettability between the glass particles and the silicide particles becomes so poor that many voids are formed in the resulting sintered resistor. As a result, the conductor material to be connected to the resistor will diffuse into the thick film resistor due to a thermal diffusion phenomenon thereof in the course of firing of the thick film resistor composition, resulting in such a disadvantage that the sheet resistivity of the resulting sintered resistor is unstable.

U.S. Pat. No. 4,119,573 (Ishida et al.) discloses a thick film resistor composition comprising molybdenum silicide, magnesium silicide, tantalum silicide, and manganese silicide as conductive phase, and, as an inorganic binder, barium borosilicate glass containing 0 to 7 wt. % of niobium pentoxide. However, it is difficult to secure desired resistance characteristics by dispersing the above-mentioned thick film resistor composition in a vehicle containing ethyl cellulose dissolved therein, forming a film by the screen printing method, and firing the film on a ceramic substrate in a non-oxidizing atmosphere as described in the above-mentioned patent. This is so because ethyl cellulose is carbonized due to its thermal oxidation decomposability, when exposed to high temperatures in a non-oxidizing atmosphere having a very low oxygen concentration, to remain in the form of residual carbon in the resulting sintered resistor to deteriorate the resistance characteristics of the resistor. When a thick film resistor composition (glass silicide ) of Ishida et al. is screen-printed using a vehicle containing a heat decomposable organic polymer used by us and is fired in a non-oxidizing atmosphere, the resistance is too scattered, and therefore high uncertainty remains in its practical use. Particularly, with the same area, the sheet resistivity varies depending on the length/width ratio (aspect ratio) of the resistor film, leading to a difficulty in designing a resistance value.

As against the above-mentioned resistor composition comprising silicides as a conductor phase, a thick film resistor composition comprising a boride such as lanthanum hexaboride as a conductor phase is disclosed in U.S. Pat. No. 4,512,917. However, this thick film resistor composition has a defect that deterioration of the resistance characteristics of the resistor formed therefrom occurs particularly in a high resistance region where a relatively large amount of the glass phase is present.

Donohue et al., "Nitrogen-Fireable Resistors: Emerging Technology For Thick Film Hybrids" Proceedings of 1987 Electronic Components Conference, May, 1987 disclosed a technique of forming fine tantalum boride by reducing tantalum pentoxide and boron oxide with the strongly reducing agent lanthanum hexaboride. According to this method, however, lanthanum trioxide is formed as a by-product and is in the nature of being slightly soluble in cold water. The resistor obtained after sintering may be in a state entirely covered with lanthanum trioxide formed by the disclosed reaction when the resistor is viewed in its entirety with consideration given to the particle diameter ratio of the lanthanum hexaboride particles to the glass particles. Since the whole of the resistor is covered with lanthanum trioxide in the nature of being soluble in cold water, it is believed that the conductor particles are flowed out together with the glass in an environmental test under high-temperature and high-humidity conditions. Because of this phenomenon, the resistor of Donohue et al. requires a glass coat without fail in order to attain a fluctuation of resistance value of less than 1%. This is a serious disadvantage because other steps of printing, drying, and firing must be taken for the formation of a thick film hybrid IC, which lengthens the production process and results in a higher cost. Further, this will become a hindrance to conversion from a noble metal type system for firing in the air to a base metal type copper thick film system in view of the fact that conventional ruthenium oxide resistors require no such glass coat.

In addition, in the case bf boride-glass type glaze resistance materials, it is very difficult to obtain a sheet resistivity of 10 kΩ/□ or over because the thermal coefficient of resistor (TCR) is a large negative value (−300 ppm/°C. or lower). Accordingly, the present state is that a conductor material such as tin oxide is used to obtain a higher sheet resistivity, particularly a sheet resistivity of 100 kΩ/□ or higher. Therefore, paste blending of a resistor paste for 10 kΩ/□ with a resistor paste for 100 kΩ/□ is impossible. Further, simultaneous firing of a boride type resistance material and a tin type resistance material was difficult due to a mutual reaction therebetween.

A resistor must have good anti-surge characteristics since it is a circuit part. In this point, the glaze resistor produced from the boride-glass type glaze resistor material undergoes a conspicuous change in the resistance value by a surge voltage in view of a difficulty in providing a particle diameter of 1 μm or smaller for the boride powder constituting the boride glass type glaze resistor material which difficulty is attributed to the preparation of the boride powder by preliminary synthesis and mechanical grinding, and because a non-uniform electric field distribution is developed inside the glass resistor.

A silicide type resistor disclosed in U.S. Pat. No. 4,695,504 that was developed by us is a resistor having very excellent humidity resistance and aspect dependency but with a limitation of 10 Ω/□ to 10 kΩ/□ in the region wherein characteristics of the resistor are satisfied. This is so because a resistor of 10 kΩ/□ or higher not only shows a high negative value of thermal coefficient, of resistor but also has a high dependency of the resistance value on firing peak temperature, leading to imposition of a large limitation on the resistor forming process.

SUMMARY OF THE INVENTION

An object of the present invention is to provide an inexpensive thick film resistor composition (containing no rare earth element) which is capable of being fired in a non-oxidizing atmosphere, coexisting with a base metal material such as a copper electrode, and being formed into a resistor with an effective temperature profile (peak temperature: 850° to 975° C.); a resistor formed from the above-mentioned resistor composition which resistor has a wide range of sheet resistivity, particularly a sheet resistivity of 10 kΩ/□ or higher, a low value of TCR, excellent humidity resistance characteristics, and excellent anti-surge characteristics; and a method of producing such resistor.

The resistor composition of the present invention, which contains no boride powder obtained by mechanical grinding, comprises at least one of silicon, silicon monoxide, and higher oxidation state precursor of silicon monoxide, and a borosilicate glass containing at least one of zirconium oxide, vanadium pentoxide, chromium oxide, tungsten trioxide, molybdenum trioxide, manganese oxide, titanium oxide, niobium pentoxide, and tantalum pentoxide which are capable of being reduced with silicon, silicon monoxide, a higher oxidation state precursor of silicon monoxide, or a silicide.

The method of producing a resistor according to the present invention comprises a step of sintering in a non-oxidizing atmosphere in which step oxides as mentioned above and boron oxide which are contained in a borosilicate glass are reduced with silicon, silicon monoxide, a higher oxidation state precursor of silicon monoxide, or silicide to precipitate fine boride around glass particles to form a glaze resistor.

Since the glaze resistor according to the present invention is formed by precipitation of fine boride of several hundreds of angstroms around glass particles, it has a sheet resistivity of 10 kΩ/□, a low value of TCR, excellent humidity resistance characteristics, and excellent anti-surge characteristics.

Among the above-mentioned oxides, zirconium oxide, niobium pentoxide, tantalum pentoxide, and titanium oxide have been found preferable in the resistor composition of the present invention from the viewpoint of resistance value and humidity resistance characteristics. The content of the above-mentioned oxide in the glass is preferably 1.0 to 12.0 mol %. When it is lower than 1 mol %, a boride as a conductor component cannot be sufficiently formed, while when it exceeds 12 mol %, the oxide cannot serve as a constituent of the glass. The content of boron oxide in the borosilicate glass is at least 10% because a sufficient amount of a boride is not formed otherwise. The weight ratio of the above-mentioned glass to silicon and/or the like is preferably 2:98 to 40:60. The particle diameter of silicon and/or the like is preferably 1 μm or smaller in order for it sufficiently contribute to a reaction although the same effect can be secured even when the particle diameter is larger than 1 μm.

In addition, since the particle diameter of the boride contained in the resistor of the present invention is determined by the degree of distribution of the above-mentioned oxide dispersed in the glass like an oxide powder obtained by a customary co-precipitation method, a particle diameter of 500 Å or smaller can be secured.

As described above, a wide variety of sheet resistors having a sheet resistivity of 10 kΩ/□ or higher and a low value of TCR can be simultaneously formed by firing the resistor composition of the present invention, and a paste capable of being blended can be prepared. Further, the resistor of the present invention which contains fine boride has excellent humidity resistance characteristics since it contains silicon dioxide having excellent humidity resistance characteristics and formed not only inside the glass particles but also around the resistor.

Also a silicide-glass type glaze resistor composition can provide the same effects including a sheet resistivity of 10 kΩ/□ or higher and a low value of TCR by using therein silicon, silicon monoxide, or a higher oxidation state precursor of silicon monoxide, and a borosilicate glass containing the above-mentioned oxides. Particularly, a resistor composition that has a little dependency on firing peak temperature, and can be produced easily can be provided so that the resistor forming process can be set within a wide range. As the silicide to be contained therein, tantalum silicide, titanium silicide, and a mixture of tantalum silicide, molybdenum silicide, and magnesium silicide are preferable although any silicide can be used. Firing is possible at a firing temperature of 850° to 975° C., preferably 890° to 925° C.

DESCRIPTION OF THE PREFERRED EMBODIMENTS

Figure 1A:
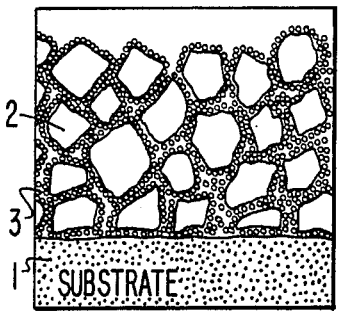
FIG. 1 is schematic crosssectional views of a resistor (a) before firing and (b) after firing in one example according to the present invention.

Description will now be made on resistor compositions of Examples according to the present invention.

EXAMPLE 1

After a high-purity silicon powder was roughly ground, it was further ground by ball milling in ethanol by using zirconium balls until a silicon powder having an average particle diameter of about 0.5 μm was obtained. Oxides comprising BaO (10 to 23 mol %), CaO (3 to 6), MgO (7 to 9), $B_2O_3$ (40 to 55), $SiO_2$ (6 to 25), and $Al_2O_3$ (7 to 9) or the corresponding carbonates, and the oxide as mentioned above to form a boride were weighed so as to provide 1 to 12 mol % of the latter, and were mixed together. The resulting mixture powder was melted at 1400° C., the melt was quenched in cool water to effect vitrification. The glass was ground by ball milling to obtain glass frits. These powders were mixed together to prepare a resistor composition. The silicon/(silicon+glass) weight ratio was from 0.02 to 0.40.

A vehicle with which the resistor composition was kneaded to prepare a paste was obtained by weighing terpineol and isobutyl methacrylate to provide a weight ratio of the latter to the total of 10% and dissolving the latter in the former. The ratio of the vehicle to the resistor composition powder was 0.4 cc per gram of the glaze resistor powder.

The resulting glaze resistor paste was screen-printed on an alumina substrate having copper electrodes by using a 325-mesh stainless steel screen. Thereafter, the paste film on the substrate was dried at 120° C. for 10 min, and was fired in a firing furnace wherein the atmosphere can be controlled. The conditions in the furnace was such that the temperature profile was in the shape of a hanging bell, 920° C. was retained for 10 min, and the total firing time was 60 min. The atmosphere during the firing was a nitrogen atmosphere, the oxygen concentration of which was in the range of 10 ppm or below that did not allow the copper electrodes to be oxidized.

The characteristics of the thus obtained glaze resistor are shown in Table 1. Incidentally, the thermal coefficient of resistor (TCR) is expressed as the amount of change in the resistance value in terms of ppm/°C. between ordinary temperature (25° C.) and 125° C. In the short term over load test, the evaluation was made in terms of percentage of change in resistance for the initial value of resistance by applying a voltage 2.5 times as high as a voltage corresponding to an electric power of 125 mW/mm$^2$. In the humidity resistance test, the evaluation was made in terms of percentage of change in resistance for the initial value of resistance after the resistor was allowed to stand in an atmosphere having a temperature of 60° C. and a relative humidity of 95% for 1000 hours. In the electro-static discharge test, the evaluation was made in terms of percentage of change in resistance for the initial value when electricity charged into a 2000-pF capacitor by applying a voltage of 500 V thereto was discharged three times into the resistor.

Figure 1B:
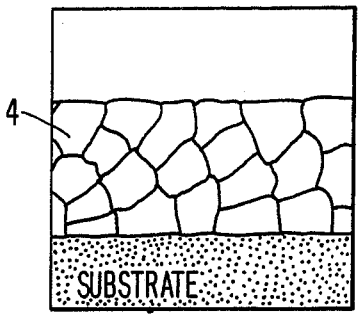

Schematic crosssectional views of the resistor before firing and after firing are shown in FIG. 1. FIG. 1 (*a*) is a schematic crosssectional view of the resistor before firing, wherein reference numeral 1 indicates a ceramic substrate, reference numeral 2 indicates glass particles, and reference numeral 3 indicates silicon particles. Since the silicon particle diameter was smaller than the glass particle diameter, there was provided a structure wherein the silicon particles surrounded the glass particles. FIG. 1 (*b*) is a schematic crosssectional view of the resistor after firing, wherein reference numeral 4 indicates a boride. The boride was a substance formed when the silicon particles reduced a specific oxide in the glass, followed by chemical combination. Therefore, the boride was formed around the glass particles when the glass was melted.

TABLE 1

| Oxide in glass (mol %) Glass: Si (weight ratio) | Sheet resistivity (Ω/□) | TCR (ppm/°C.) | Thermal humidity durability 60° C. 95% 1000 hrs (%) | STOL ΔR/R (%) | Anti-surge 2000 pF, 500 V ΔR/R (%) | X-ray diffraction |
|---|---|---|---|---|---|---|
| $ZrO_2$ (4.2) $Nb_2O_5$ (0.4) 85:15 | 105k | −256 | +1.1 | −0.1 | −0.5 | $ZrB_2$ Si |
| $Ta_2O_5$ (2.4) 80:20 | 134k | −278 | +0.3 62k | −0.1 | −0.3 | $TaB_2$ Si |
| $Nb_2O_5$ (2.8) 90:10 | 62R | −112 | +0.9 | −0.2 | −0.9 | $NbB_2$ Si |
| $V_2O_5$ (2.3) 98:2 | 54k | −102 | +2.1 | −0.9 | −1.8 | $VB_2$ Si |
| $TiO_2$ (6.3) $Nb_2O_5$ (0.4) 85:15 | 41k | −89 | +0.8 | −0.2 | −0.9 | $TiB_2$ Si |
| $MnO_2$ (7.1) 88:12 | 37k | −74 | +2.6 | −0.4 | −1.7 | $MnB_2$ Si |
| $WO_3$ (5.6) 92:8 | 23k | −62 | +2.7 | −0.6 | −2.1 | $WB_2$ Si |
| $MoO_3$ (2.1) 80:20 | 51k | −129 | +1.6 | −0.7 | −1.6 | $MoB_2$ Si |
| $CrO_2$ (3.6) 87:13 | 53k | −104 | +1.3 | −0.8 | −2.1 | $CrB_2$ Si |
| $Nb_2O_5$ (2.0) 60:40 | 193k | −221 | +1.1 | −0.4 | −1.0 | $NbB_2$ Si |

As described above, according to Example 1, since the boride in a boride-glass resistance element which was produced from a resistor composition according to the present invention was formed by reducing, with silicon, the oxide as mentioned above and boron oxide which were contained in the borosilicate glass in a step of firing in a non-oxidizing atmosphere, fine boride particles were obtained, so that a high-performance glaze resistor having a sheet resistivity of 10 kΩ/□ or over, a low TRC, and excellent anti-surge characteristics were constructed.

EXAMPLE 2

Description will now be made on a second Example according to the present invention in which silicon monoxide was used.

After a silicon monoxide reagent was roughly ground, it was further ground by ball milling in ethanol by using zirconium balls until a silicon monoxide powder having an average particle diameter of 0.5 μm was obtained. Glass frits were prepared in the same manner as in Example 1. These powders were mixed together to prepare a glaze resistor powder. The same procedure of mixing and kneading as in Example 1 was repeated to obtain a glaze resistor paste.

The glaze resistor paste was printed on an alumina substrate having copper electrodes by using a 325-mesh stainless steel screen in the same manner as in Example 1. Thereafter, the resulting thick film on the substrate was dried at 120° C. for 10 min and fired in the same manner as in Example 1 in a firing furnace in which the atmosphere can be controlled.

The resistance characteristics of the resulting glaze resistor are shown in Table 2.

TABLE 2

| Oxide in glass (mol %) Glass: Si (weight ratio) | Sheet resistivity (Ω/□) | TCR (ppm/° C.) | Thermal humidity durability 60° C., 95% 1000 hrs (%) | STOL ΔR/R (%) | Anti-surge 2000 pF, 500 V ΔR/R (%) | X-ray diffraction |
|---|---|---|---|---|---|---|
| $ZrO_2$ (4.2) $Nb_2O_5$ (0.4) 85:15 | 102k | −106 | +2.1 | −0.2 | −1.3 | $ZrB_2$ amorophous |
| $Ta_2O_5$ (2.4) 80:20 | 130k | −185 | +0.6 | −0.2 | −0.5 | $TaB_2$ amorphous |
| $Nb_2O_5$ (2.8) 90:10 | 52k | +54 | +0.8 | −0.6 | −1.2 | $NbB_2$ amorphous |
| $V_2O_5$ (2.3) 98:2 | 43k | −118 | +2.4 | −1.3 | −3.7 | $VB_2$ amorphous |
| $TiO_2$ (6.3) $Nb_2O_5$ (0.4) 85:15 | 32k | +12 | +0.9 | −0.3 | −1.2 | $TiB_2$ amorphous |
| $MnO_2$ (7.1) 88:12 | 21k | −43 | +3.4 | −0.7 | −2.1 | $MnB_2$ amorphous |
| $WO_3$ (5.6) 92:8 | 18k | −184 | +2.3 | −0.5 | −3.5 | $WB_2$ amorphous |
| $MoO_3$ (2.1) 80:20 | 42k | −156 | +1.8 | −0.9 | −2.4 | $MoB_2$ amorphous |
| $CrO_2$ (3.6) | 67k | −84 | +1.9 | −0.9 | −3.4 | $CrB_2$ |

TABLE 2-continued

| Oxide in glass (mol %) Glass: Si (weight ratio) | Sheet resistivity (Ω/□) | TCR (ppm/° C.) | Thermal humidity durability 60° C., 95% 1000 hrs (%) | STOL ΔR/R (%) | Anti-surge 2000 pF, 500 V ΔR/R (%) | X-ray diffraction |
|---|---|---|---|---|---|---|
| 87:13 | | | | | | amorphous |
| $Nb_2O_5$ (2.0) | 223k | −223 | +1.1 | −0.3 | −0.9 | $NbB_2$ |
| 60:40 | | | | | | amorphous |

As described above, also according to Example 2, since a boride in a boride-glass resistance element which was produced from a resistor composition according to the present invention was formed by reducing, with silicon, the oxide as mentioned above and boron oxide which were contained in a borosilicate glass in a step of firing in a non-oxidizing atmosphere, fine boride particles were obtained, so that a high-performance glaze resistor having a sheet resistivity of 10 kΩ/□ or over, a low TCR, and excellent anti-surge characteristics was constructed. Incidentally, the average particle diameter of the boride was 120 to 470 Å which was measured by using an X-ray diffraction pattern. Further, a resistor composition wherein the glass particles were large was prepared and when the amounts of silicon inside the glass particles between before and after firing were compared by using an X-ray microanalyzer, it was found that the amount of silicon after the firing increased, thus proving that an improvement in humidity resistance was attributable to silicon.

Although the firing was carried out in a nitrogen atmosphere in the forgoing Example, any non-oxidizing atmosphere can be used as the firing atmosphere and the firing can also be carried out in a reducing atmosphere containing less than 7% of hydrogen. The firing may be carried out at a firing temperature in the range of 850° to 975° C., preferably in the range of 890° to 925° C. Although the silicon powder and the silicon monoxide powder of 0.5 μm were used in the foregoing Example, any average particle diameter within the range of 1 μm or smaller is acceptable to obtain fine boride with good results without adversely affecting the characteristics of the resistor. Although, in the foregoing Example, a silicon powder and a silicon monoxide powder were used, other substitute may be used if it functions as a reducing agent, and for example the same effects can be secured by using any higher oxidation state precursor of silicon monoxide such as $Si_2O_3$, and $Si_3O_5$. These silicon powder, silicon monoxide powder, and higher oxidation state precursors of silicon monoxide can be used in combination. Further, the silicon powder, silicon monoxide powder, and higher oxidation state precursors of silicon monoxide are not necessarily crystalline, and may be amorphous to secure the same effects.

Although iso-butyl methacrylate was used as an organic polymer in the foregoing Example, any organic polymer can be used so far as it is capable of depolymerization at low temperatures to escape through decomposition. For example, polytetrafluoroethylene, poly-α-methylstyrene, and polymethyl methacrylate can be used alone or in combination, or they may be used after copolymerization thereof.

EXAMPLE 3

Description will now be made on a resistor composition wherein a silicide and a silicon monoxide powder were used.

A silicide raw material powder with a composition having a molar ratio of $Mg_2Si$ to $TaSi_2$ of 50:50 and a molar ratio of the total molar amount of $Mg_2Si$ and $TaSi_2$ to $MoSi_2$ of 95:5 was heat-treated in argon at a temperature of 1200° C. to synthesize a silicide powder. This silicide powder was ground by ball milling in xylene using WC balls to obtain a conductor material having an average particle diameter of 0.7 μm. A glass frit and a silicon powder were prepared in the same manner as in Example 1. 2 mol % of tantalum pentoxide were contained in the glass frit to be used herein. These powders were mixed together to prepare a glaze resistor powder. The silicide/(silicide+glass) ratio was from 0.1 to 0.4 by weight. The ratio of the silicon monoxide powder to the glass was 2 wt. %.

The glaze resistor powder was kneaded, printed, dried and fired in the same manner as in Example 1. The conditions in the furnace were such that 910° C. were retained for 10 min, and the total time was 60 min. The resistance characteristics of the thus obtained glaze resistor material are shown in Table 3.

TABLE 3

| Ratio of silicide SiO:glass | Silicide / Silicide + Glass | Sheet resistivity (Ω/□) | TCR (ppm/°C.) | Thermal humidity durability 60° C., 95%, 1000 hrs (%) | STOL ΔR/R (%) |
|---|---|---|---|---|---|
| $MoSi_2$:$TaSi_2$:$Mg_2Si$ = | 0.05 | 70.4K | −615 | 0.72 | 0.21 |
| 5:47.5:47.5 | 0.10 | 30.5K | −441 | 0.61 | 0.18 |
| SiO:glass = | 0.20 | 5.4K | −82 | 0.47 | 0.14 |
| 2:98 | 0.30 | 0.9K | +103 | 0.28 | 0.07 |
| | 0.40 | 0.6K | +183 | 0.13 | 0.06 |

As described above, according to Example 3, since the resistor composition was comprised by a conductor powder of molybdenum silicide, tantalum silicide, and magnesium silicide, and a glass powder plus a silicon powder, the resistor composition could be easily fired in a neutral atmosphere to form a high-performance glaze resistor capable of coexisting with a base metal material.

EXAMPLE 4

A silicide with a composition having a molar ratio of $MoSi_2$:$TaSi_2$:Mg6hd 2Si of 5:95:5 was synthesized in argon at a temperature of 1200° C., and a conductor material was obtained in the same manner as in Example 3. A glaze resistor material was formed by using the same procedure as in Example 3. The weight ratio of the silicon monoxide to the glass was 10 wt. %. The resistance characteristics of the glaze resistor material are shown in Table 4.

TABLE 4

| Ratio of silicide SiO:Glass | Silicide / Silicide + Glass | Sheet resistivity (Ω/□) | TCR (ppm/°C.) | Thermal humidity durability 60° C., 95%, 1000 hrs (%) | STOL ΔR/R (%) |
|---|---|---|---|---|---|
| $MoSi_2$:$TaSi_2$:$Mg_2Si$ = | 0.05 | 9.8K | −184 | 0.21 | 0.17 |
| 5:95:5 | 0.10 | 10.7K | −256 | 0.17 | 0.11 |
| SiO:glass = | 0.20 | 30.4K | −415 | 0.14 | 0.09 |
| 10:90 | 0.30 | 72.4K | −618 | 0.05 | 0.08 |
| | 0.40 | 103.6K | −760 | 0.06 | 0.08 |

As described above, according to Example 4, the firing can also be easily carried out in a neutral atmosphere similarly to Example 3 to form a high-performance glaze resistor capable of coexisting with a base metal material.

EXAMPLE 5

A silicide with a composition having a molar ratio of $MoSi_2$ : TaSi : $Mg_2Si$ of 50:25:25 was synthesized in argon at a temperature of 1200° C., and a conductor material was prepared in the same manner as in Example 3. A glaze resistor material was formed by using the same procedure as in Example 3. The weight ratio of the silicon monoxide powder to the glass was 20 wt. %. The resistance characteristics of the glaze resistor material are shown in Table 5.

TABLE 5

| Ratio of silicide SiO:Glass | Silicide / Silicide + Glass | Sheet resistivity (Ω/□) | TCR (ppm/°C.) | Thermal humidity durability 60° C., 95%, 1000 hrs (%) | STOL Δr/r (%) |
|---|---|---|---|---|---|
| $MoSi_2$:$TaSi_2$:$Mg_2Si$ = | 0.05 | 12.3k | −80 | 0.20 | 0.18 |
| 50:25:25 | 0.10 | 30.4k | −300 | 0.15 | 0.11 |
| SiO:glass = | 0.20 | 60.3k | −406 | 0.13 | 0.15 |
| 20:80 | 0.30 | 121.4k | −763 | 0.11 | 0.08 |
| | 0.40 | 235.6k | −1542 | 0.08 | 0.07 |

As described above, according to Example 5, the firing can be also carried out easily in a neutral atmosphere similarly to Example 3 to form a high-performance glaze resistor capable of coexisting with a base metal material.

EXAMPLE 6

Titanium silicide was synthesized in argon at 1200° C., and a conductor material was prepared in the same manner as in Example 3. The weight ratio of the silicon monoxide powder to the glass was 5 wt. %. The resistance characteristics thereof are shown in Table 6.

TABLE 6

| Ratio of silicide Si:Glass | Silicide / Silicide + Glass | Sheet resistivity (Ω/□) | TCR (ppm/°C.) | Thermal humidity durability 60° C., 95%, 1000 hrs (%) | STOL ΔR/R (%) |
|---|---|---|---|---|---|
| $TiSi_2$ = 100 | 0.05 | 354.5K | −673 | 0.85 | 1.21 |
| SiO:glass = | 0.10 | 10.4K | −125 | 0.12 | 0.63 |
| 5:95 | 0.20 | 2.1K | +13 | 0.11 | 0.31 |
| | 0.30 | 0.8K | +184 | 0.07 | 0.21 |
| | 0.40 | 0.3K | +203 | 0.06 | 0.11 |

As described above, according to Example 6, the firing can also be carried out easily in a neutral atmosphere similarly to Example 3 to form a high-performance glaze resistor capable of coexisting with a base metal material.

Figure 2:
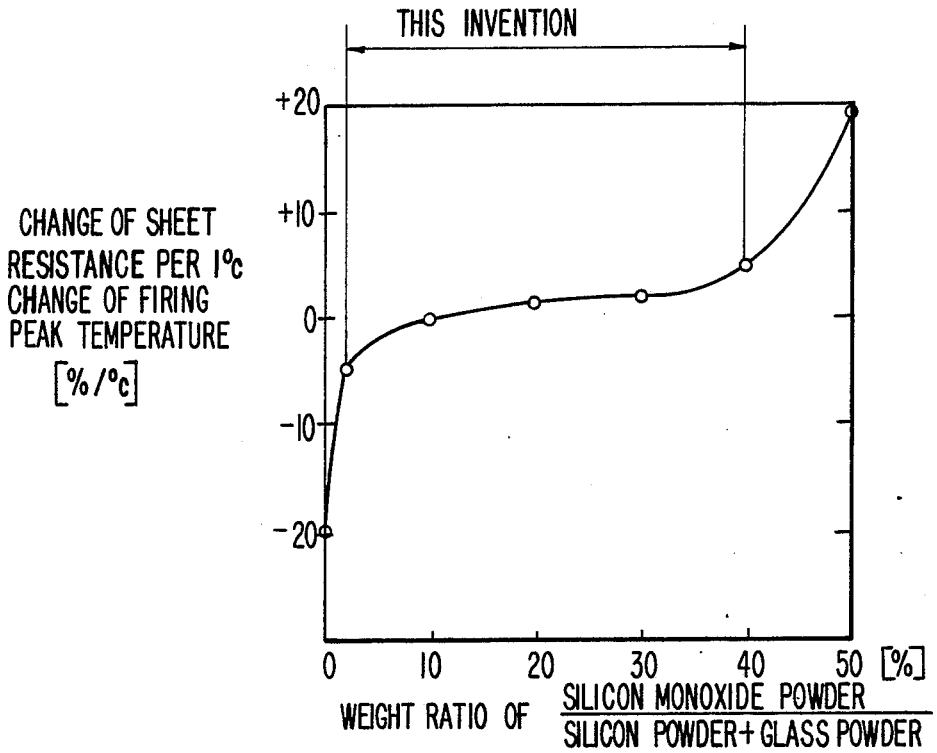
FIG. 2 firing stabilization graph showing a relationship between weight ratios of silicon monoxide powder/(silicon powder glass powder) and amounts of change FR (%/°C) in the sheet resistivity of a formed sheet resistor per 1° C. in firing peak temperatures in one example according to the present invention.

FIG. 2 is a firing stabilization graph showing a relationship between weight ratios of silicon powder/(silicon powder+glass powder) and amounts of change FR (%/°C) in the sheet resistivity of a formed sheet resistor per 1° C. in firing peak temperatures. As can be understood from FIG. 2, in the range of the silicon powder to the glass powder ratio of from 2:98 to 40:60, the sheet resistivity value is less dependent on the peak temperature at the time of firing to provide a stable sheet resistivity. The borides formed herein were $TaB_2$ and $TiB_2$ in Examples 5 and 6, respectively, and the average particle diameters of the $TaB_2$ and $TiB_2$ were found to be about 150 Å when measured by using an X-ray diffraction pattern.

Further, a resistor composition wherein the glass particles were large was prepared and when the amounts of silicon inside the glass particles between before and after firing were compared by using an X-ray microanalyzer, it was found that the amount of silicon after the firing increased.similarly to Examples 1 to 3, thus proving that an improvement in humidity resistance was attributable to silicon.

Although 2 mol % of tantalum pentoxide were contained in the glass frit used herein, the same effects can be obtained using other oxide. For example, zirconium oxide and niobium oxide can be used to obtain $ZrB_2$ and $NbB_2$ having approximately the same average particle diameter, respectively. It is good when the the amount of the oxides in the glass is 2 mol % or over, preferably 2 to 10.0%. As stated above, the incorporation of a silicon monoxide powder into a silicide-glass resistor composition enables the firing to be easily carried out in a neutral atmosphere to form a high-performance glaze resistor capable of coexisting with a base metal material and high in firing stability.

Although silicon monoxide was used in the foregoing Example, the same effects can also be secured using a silicon powder. Although the firing was carried out in a nitrogen atmosphere in the foregoing Example, any non-oxidizing atmosphere can be used, and the firing can be carried out in a reducing atmosphere containing less than 7% of hydrogen. Although a silicon monoxide powder of 0.5 μm was used in the foregoing Example, the particle average diameter of 1 μm or less will do for securing fine boride with good results without adversely affecting the characteristics of the resistor. Silicon can be used in the composition with organo-metalic phase. Any silicides can be used herein, with tantalum silicide, titanium silicide, or a mixture of tantalum silicide, molybdenum silicide, and magnesium silide preferable.

As discussed above, the resistor composition according to the invention contains no boride, but provides fine boride in a step of firing in a non-oxidizing atmosphere for the formation of a glaze resistor in which step the oxide as mentioned above and boron oxide contained in a borosilicate glass are reduced with silicon, silicon monoxide, or a silicide. Therefore, the dependency of the formed resistor on the firing peak temperature is low, the production of the resistor is easy, the thermal coefficient of the resistor is low at a sheet resistivity of 10 kΩ/□, a wide variety of sheet resistors can be fired simultaneously, and a paste that can be blended can be prepared.

Further, since a boride having a fine particle diameter on the order of several hundreds of angstroms can be formed, an effect of improving anti-surge characteristics can be secured. Furthermore, since the powder that is required to be ground is a brittle material such as silicon, silicon monoxide, or silicides, incorporation of impurities thereinto in the grinding step can be minimized. Moreover, since the dependency of the resistance value of the formed resistor on the firing peak temperature is low, the resistor forming process can be set within a wide range.

Further, the resistor according to the present invention has excellent humidity resistance characteristics since silicon oxide having excellent humidity resistance characteristics is formed inside glass particles and around the resistor simultaneously with formation of fine boride.

Figure 3:
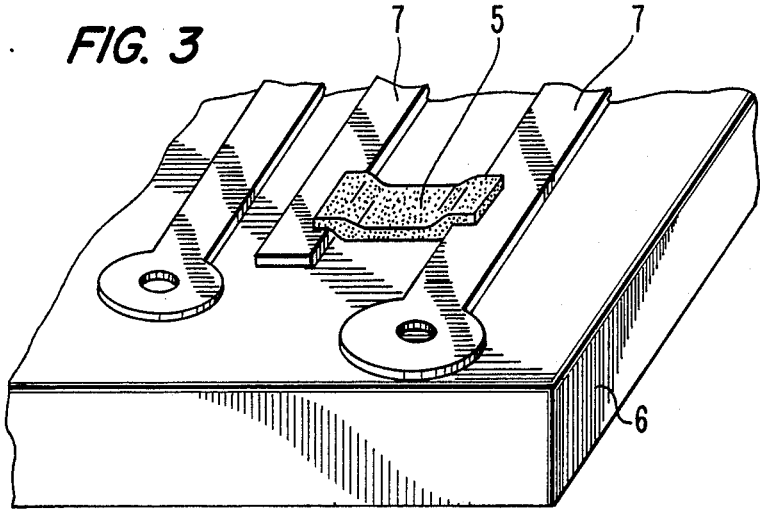

FIG. 3 is a perspective view of a hybrid IC wherein the resistor in the above-mentioned Example is actually used. Reference numeral 5 indicates the resistor of the above-mentioned Example, reference numeral 6 indicates a ceramic substrate, and reference numeral 7 indicates copper electrodes.

What is claimed is:

1. A resistor composition which comprises: at least one of silicon, silicon monoxide, and higher oxidation state precursor of silicon monoxide; and a borosilicate glass containing at least one of zirconium oxide, vanadium pentoxide, chromium oxide, tungsten trioxide, molybdenum trioxide, manganese oxide, titanium oxide, niobium pentoxide and tantalum pentoxide.

2. A resistor composition as claimed in claim 1, wherein the total content of said oxide in the glass is 1.0 to 12.0 mol %.

3. A resistor composition as claimed in claim 1, wherein at least 10.0 mol % of boron oxide is contained in said borosilicate glass.

4. A resistor composition as claimed in claim 1, wherein the average particle diameter of said silicon, said silicon monoxide, and said higher oxidation state precursor is 1 μm or below.

5. A resistor composition as claimed in claim 1, wherein the weight ratio of said silicon, said silicon monoxide, and/or said higher oxidation state precursor of silicon monoxide to said glass is 2:98 to 40:80.

6. A resistor composition which comprises: a borosilicate glass containing at least one of zirconium oxide, vanadium pentoxide, chromium oxide, tungsten trioxide, molybdenum trioxide, manganese oxide, titanium oxide, niobium pentoxide, and tantalum pentoxide; at least one of silicon, silicon monoxide and higher oxidation state precursor of silicon monoxide; and a silicide powder.

7. A resistor composition as claimed in claim 6, wherein said silicide powder comprises titanium silicide.

8. A resistor composition as claimed in claim 6, wherein said silicide powder comprises tantalum silicide.

9. A resistor composition as claimed in claim 6, wherein said silicide powder comprises tantalum silicide, molybdenum silicide, and magnesium silicide.

10. A resistor composition as claimed in claim 6, wherein the weight ratio of said silicon, said silicon monoxide, and/or said higher oxidation state precursor of silicon monoxide to said glass is 2:98 to 40:80.

11. A resistor composition as claimed in claim 6, wherein the average particle diameter of said silicide, said silicon, said silicon monoxide, and said higher oxidation state precursor of silicon monoxide is 1 μm or below.

12. A resistor formed from a resistor composition which comprises at least one of silicon, silicon monoxide, and higher oxidation state precursor of silicon monoxide; and a borosilicate glass containing at least one of zirconium oxide, vanadium pentoxide, chromium oxide, tungsten trioxide, molybdenum trioxide, manganese oxide, titanium oxide, niobium pentoxide and tantalum pentoxide.

13. A resistor as claimed in claim 12, wherein said boride comprises at least one of zirconium boride, vanadium boride, chromium borides, tungsten boride, molybdenum boride, manganese boride, titanium boride, niobium boride, and tantalum boride.

14. A resistor as claimed in claim 12, wherein said boride comprises at least one of $ZrB_2$, $TaB_2$, $NbB_2$, and $TiB_2$

15. A resistor as claimed in claim 12 wherein the average particle diameter of said boride is 500 Å or below.

16. A resistor formed from a resistor composition which comprises a borosilicate glass containing at least one of zirconium oxide, vanadium pentoxide, chromium oxide, tungsten trioxide, molybdenum trioxide, manganese oxide, titanium oxide, niobium pentoxide, and tantalum pentoxide; at least one of silicon, silicon monoxide and higher oxidation state precursor of silicon monoxide; and a silicide powder.

17. A resistor as claimed in claim 16, wherein said silicide comprises titanium silicide.

18. A resistor as claimed in claim 16, wherein said silicide comprises tantalum silicide.

19. A resistor as claimed in claim 16, wherein said silicide comprises tantalum silicide, molybdenum silicide, and magnesium silicide.

20. A resistor as claimed in claim 16, wherein said boride comprises at least one of $ZrB_2$, $TaB_2$, $NbB_2$, and $TiB_2$.

21. A resistor as claimed in claim 16, wherein the average particle diameter of the boride is 500 Å or below.

22. A method of producing a resistor comprising the steps of: forming a resistor paste by dispersing into a vehicle a resistor powder comprising at least one of silicon, silicon monoxide and higher oxidation state precursor of silicon monoxides; and a borosilicate glass containing at least one of zirconium oxide, vanadium pentoxide, chromium oxide, tungsten trioxide, molybdenum trioxide, manganese oxide, titanium oxide, niobium pentoxide and tantalum pentoxide; applying said resistor paste on a ceramic substrate; drying the applied resistor paste; and firing the dried resistor paste in a non-oxidizing atmosphere.

23. A method of producing a resistor as claimed in claim 22, wherein, in the step of firing in a non-oxidizing atmosphere, said oxide and a boron oxide are reduced with the silicon, the silicon monoxide, and/or the higher oxidation state precursor of silicon monoxide thereby forming a boride from a metal element constituting said oxide and boron.

24. A method of producing a resistor as claimed in claim 22, wherein the concentration of oxygen in the step of firing in a non-oxidizing atmosphere is 10 ppm or below.

25. A method of producing a resistor as claimed in claim 22, wherein the temperature of a high temperature retaining section in the step of firing in a non-oxidizing atmosphere is 850° to 975° C.

26. A method of producing a resistor comprising the steps of: forming a resistor paste by dispersing into a vehicle a resistor powder comprising at least one of silicon, silicon monoxide and higher oxidation state precursor of silicon monexide; a borosilicate glass containing at least one of zirconium oxide, vanadium pentoxide, chromium oxide, tungsten trioxide, molybdenum trioxide, manganese oxide, titanium oxide, niobium pentoxide and tantalum pentoxide, and a silicide powder; applying said resistor paste on an inorganic material; drying the applied resistor paste; and firing the dried resistor paste in a non-oxidizing atmosphere.

27. A method of producing a resistor as claimed in claim 26, wherein, in the step of firing in a non-oxidizing atmosphere, said oxide and a boron oxide are reduced with the silicon, the silicon monoxide, and the higher oxidation state precursor of silicon monoxide and the silicide powder thereby forming a boride from a metal element constituting said oxide and boron.

28. A method of producing a resistor as claimed in claim 26, wherein the concentration of oxygen in the step of firing in a non-oxidizing atmosphere is 10 ppm or below.

29. A method of producing a resistor as claimed in claim 26, wherein the temperature of a high temperature retaining section in the step of firing in a non-oxidizing atmosphere is 850° to 975° C.

30. A circuit board having a particular thick film resistor as claimed in claim 12, 13, 14, 15, 16, 17, 18, 19, 20 or 21, and a copper electrode formed on a ceramic substrate and connected to said resistor.

31. A circuit board as claimed in claim 30, wherein said ceramic substrate is an alumina substrate.

* * * * *